United States Patent [19]

Ochiai et al.

[11] Patent Number: 4,509,492

[45] Date of Patent: Apr. 9, 1985

[54] DIESEL ENGINE WITH EGR CONTROL

[75] Inventors: Kouji Ochiai; Hitoshi Tomita, both of Higashimatsuyama, Japan

[73] Assignee: Diesel Kiki Co., Ltd., Tokyo, Japan

[21] Appl. No.: 481,372

[22] Filed: Apr. 1, 1983

[30] Foreign Application Priority Data

Apr. 6, 1982 [JP] Japan ..... 57-49567

[51] Int. Cl.[3] ..... F02M 25/06

[52] U.S. Cl. ..... 123/569

[58] Field of Search ..... 123/569, 568

[56] References Cited

U.S. PATENT DOCUMENTS

| | | | |
|---|---|---|---|
| 4,300,515 | 11/1981 | Straubel et al. | 123/569 |
| 4,369,753 | 1/1983 | Sugiyama | 123/569 |
| 4,387,693 | 6/1983 | Romblom | 123/569 |

FOREIGN PATENT DOCUMENTS

| | | | |
|---|---|---|---|
| 26253 | 2/1982 | Japan | 123/569 |
| 108450 | 7/1982 | Japan | 123/569 |
| 157047 | 9/1982 | Japan | 123/569 |
| 157048 | 9/1982 | Japan | 123/569 |
| 171057 | 10/1982 | Japan | 123/569 |

*Primary Examiner*—Parshotam S. Lall
*Assistant Examiner*—W. R. Wolfe
*Attorney, Agent, or Firm*—John E. Toupal; Harold G. Jarcho

[57] ABSTRACT

A Diesel engine including a load responsive mechanism providing a load mechanical output dependent on the load on the engine; a source of vacuum pressure; a load pressure converter communicating with said source and coupled to said load responsive mechanism, the load pressure converter providing a load vacuum pressure level dependent on the load mechanical output; a speed responsive mechanism providing a speed mechanical output dependent on the revolution rate of the engine; a speed pressure converter communicating with the load pressure converter and coupled to the speed responsive mechanism, the speed pressure converter providing an output vacuum pressure level dependent on the load vacuum pressure level and the speed mechanical output; and an EGR control valve for regulating the flow of gases between the exhaust and the intake of the engine in response to the output vacuum pressure level.

9 Claims, 5 Drawing Figures

DIESEL ENGINE WITH EGR CONTROL

BACKGROUND OF THE INVENTION

1. Field of the Invention

The present invention relates generally to Diesel engines and, more particularly, to Diesel engines with EGR control devices.

2. Description of the Prior Art

EGR control devices are used to reduce NOx (nitrogen oxide) emissions from Diesel engines. Typically an EGR control device controls the quantity of exhaust gases that are recirculated to an intake of the engine in response to the engine's rpm rate and load. In prior art devices, the load on the engine is detected by a potentiometer that monitors changes in the operating angle of an accelerating lever whereas the engine's rpm rate is detected by an electromagnetic coil type pick-up. An electromagnetic actuator responds to the detected signals to adjust the opening of an EGR control valve provided in a passage between an exhaust pipe and an intake pipe.

However, one disadvantage of prior EGR control devices is their relatively high cost resulting from the special electric detectors that are used to detect the engine's load and rpm rate and the electromagnetic actuator used to control exhaust recirculation.

SUMMARY OF THE INVENTION

The invention is a Diesel engine including a load responsive mechanism providing a load mechanical output dependent on the load on the engine; a source of vacuum pressure; a load pressure converter communicating with said source and coupled to said load responsive mechanism, the load pressure converter providing a load vacuum pressure level dependent on the load mechanical output; a speed responsive mechanism providing a speed mechanical output dependent on the revolution rate of the engine; a speed pressure converter communicating with the load pressure converter and coupled to the speed responsive mechanism, the speed pressure converter providing an output vacuum pressure level dependent on the load vacuum pressure level and the speed mechanical output; and an EGR control valve for regulating the flow of gases between the exhaust and the intake of the engine in response to the output vacuum pressure level. The use of a pressure responsive EGR control system significantly reduces the overall cost of the Diesel engine.

According to one feature of the invention the load responsive mechanism comprises an accelerator means for controlling the rate at which fuel is supplied to the engine, and the mechanism is responsive to the fuel discharge pressure of the engine's fuel feed pump. Obtaining the necessary load and rpm rate information is simplified by use of the engine's accelerator and fuel pump discharge pressure.

According to another feature of the invention, the load pressure converter comprises a load housing, a flexible load diaphragm retained by the housing and disposed between an atmospheric chamber communicating with the atmosphere and an actuating chamber communicating with both the source and the atmosphere. The actuating chamber provides the load vacuum pressure level and a load valve controls the degree of gas flow between the actuating chamber and both the atmosphere and the source in response to the load mechanical output.

According to yet another feature of the invention the load responsive mechanism comprises a bias means exerting a force on the load valve and a cam for altering the force in response to the load mechanical output, and the speed pressure converter comprises a speed housing defining an output chamber communicating with the load vacuum pressure and the atmosphere and providing the output vacuum pressure. A speed valve controls the degree of gas flow between the output chamber and both the atmosphere and the load vacuum pressure and the speed valve is controlled by the speed mechanical output.

According to still another feature of the invention, the speed responsive mechanism comprises a control chamber partially defined by a flexible control diaphragm and receiving the fuel discharge pressure of the engine's fuel pump. Movement of the flexible control diaphragm in response to changes in said fuel discharge pressure provides the speed mechanical output in a simple and efficient manner.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
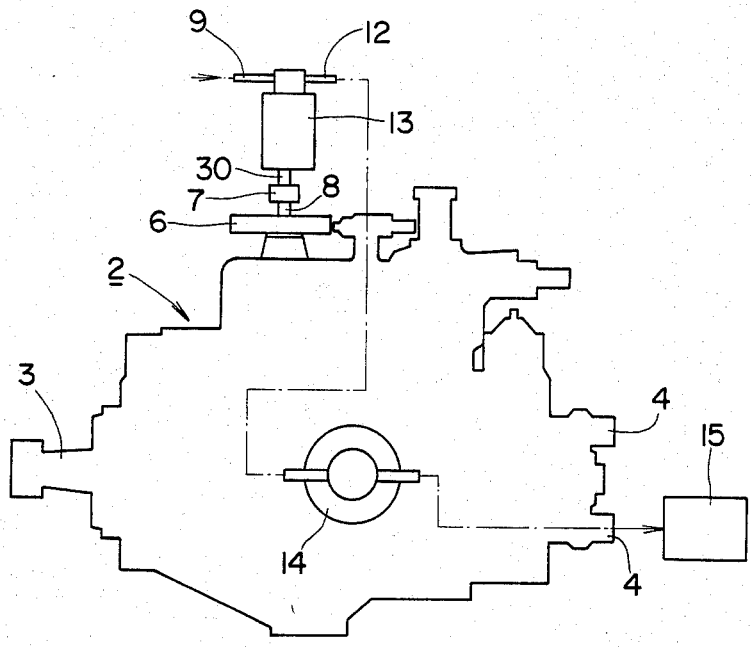
FIG. 1 is a side view schematically illustrating a Diesel engine with an EGR control device in accordance with the present invention.

An EGR control device in accordance with the present invention is arranged on a Diesel engine's fuel injection apparatus as shown in FIG. 1. A distribution type fuel injection apparatus 2 has a shaft 3, which is rotated and driven by the engine. In the conventional manner the fuel injection apparatus 2 drives a fuel feed pump and a fuel feed plunger is subjected to rotation and reciprocating movement through a well known Oldham's coupling (not shown). Fuel flowing into the housing of fuel injection apparatus 2 from a fuel tank by the feed pump is fed under pressure to a pressure chamber of a fuel feed plunger barrel and then to cylinders of the engine via delivery valves 4 arranged on the housing. An accelerating lever 6 for controlling a quantity of fuel injection is supported on the upper wall portion of the housing by a shaft 8 and is operated by an accelerator pedal (not shown) of the vehicle. Such a configuration of the fuel injection apparatus is well known, and the internal configuration thereof will not be further described. Examples of such structure are disclosed in U.S. patent application Ser. No. 06/378,893 now abandoned, assigned to the assignee of this invention.

In accordance with the present invention, a load pressure converter 13 produces a vacuum pressure level dependent on the operational position of the accelerator 6. The load dependent pressure is fed to a speed pressure converter 14 responsive to the outlet fuel pressure of a fuel feed pump in the apparatus 2. That pressure is proportional to the rpm of the engine. An EGR control valve 15 is driven by an output vacuum pressure from the converter 14.

Figure 2:
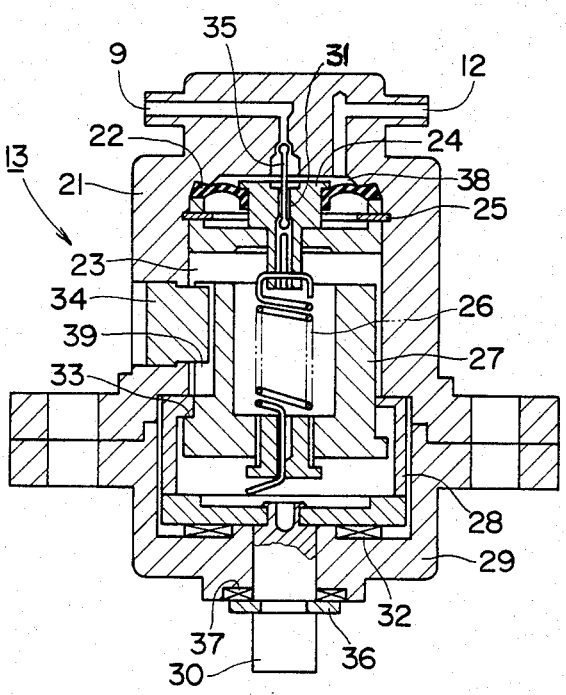
FIG. 2 is a schematic cross-sectional view of a load pressure converter of the engine shown in FIG. 1.

As shown in FIG. 2 the load pressure converter 13 includes cup-like split bodies 21 and 29 coupled together to form a housing. A load diaphragm 22 is retained within the split body 21 by a ring 25 and separates an atmospheric chamber 23 from an actuating chamber 38. Communicating with the actuating chamber 38 is an output passage 12 and an inlet passage 9 also communicating with a vacuum pressure source such as the intake manifold of the engine.

The actuating chamber 38 and the atmospheric chamber 23 communicate via a central passge 31 through a rod 24 supported on the diaphragm 22. Slidably mounted in the passage 31 is a double-headed valve 35 for alternatively opening and closing either the passage 31 or the inlet passage 9. Opposite ends of the valve 35 are arranged to engage with and disengage from respectively, a valve seat provided on the inlet passage 9 and a valve seat formed in the passage through the rod 24.

A spring 26 extends between the rod 24 and a slidable body 27 retained within the housing 21, 29. Formed in the slidable body 27 is an outer peripheral surface of an axial groove 39 which engages a fixed member 34 that prevents rotation of the body 27. A cam surface 33 provided on the lower end of the slidable body 27 is urged into engagement with a cam member 28 by the spring 26.

A bottom end of the cylindrical cam member 28 is connected to a shaft 30. The cam member 28 and shaft 30 are restrained axially but are rotatably supported by bearings 32 and 37. The shaft 30 is connected to the shaft 8 of the accelerator lever 6 by a coupling 7, as shown in FIG. 1. Thus, rotational movement of the shaft 8 provides a mechanical output dependent on the load on the engine.

Figure 3:
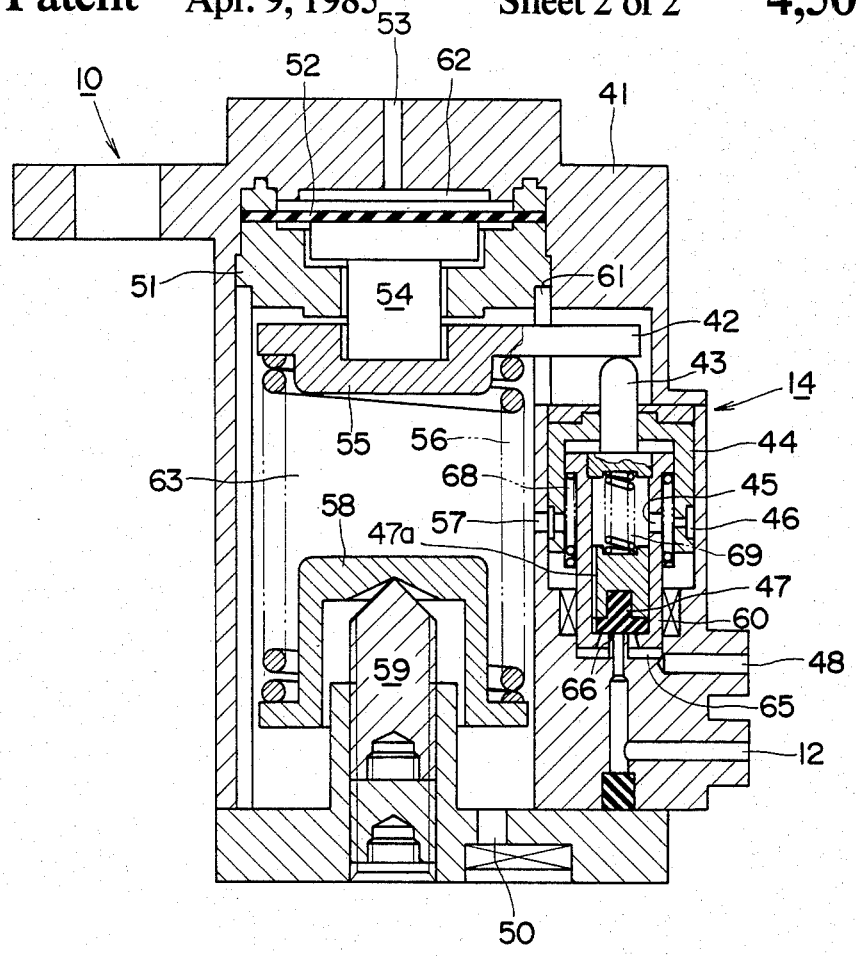
FIG. 3 is a schematic cross-sectional view of a speed pressure converter for the engine shown in FIG. 1.

As shown in FIG. 3, the speed pressure converter 14 is integrally formed with an engine rpm detector 10 in which a control diaphragm 52 is retained within a cylindrical housing 41 by a supporting member 51. The control diaphragm 52 separates a control chamber 62 from an atmospheric chamber 63 and the fuel discharge pressure of the engines feed pump is applied to the control chamber 62 via an inlet passage 53. A spring seat 55 bears on one end of a rod 54 connected to the diaphragm 52 whereas a spring seat 58 bears on the end wall of the housing 41 via an adjusting bolt 59. Interposed between the spring seats 55 and 58 is a spring 56.

The speed pressure converter 14 is formed integrally with the peripheral wall portion of the housing 41. Mechanically coupled to the converter 14 is an arm 42 extending from the seat 55 and projecting through a slot 61 in the housing 41. The arm 42 bears against a rod 43 formed integrally with a sleeve 60. A cylindrical valve housing 44 is loosely fitted and supported in a wall of the housing 41 and retains the sleeve 60. Urging the sleeve 60 upwardly is a spring 68 so as to force the rod 43 against the arm 42.

A valve body 47 having a resilient seat is slidably supported within the sleeve 60 and is urged against a valve seat 66 thereon by a spring 69. The sleeve 60 is slidably fitted within an output chamber 65 formed in the wall of the housing 41. Communicating with the chamber 65 is an output passage 48 for providing an output vacuum pressure to an actuator for driving the EGR control valve 15. Also communicating with the output chamber 65 via the valve seat 66 is the load pressure level in the passage 12 from the load pressure converter 13.

OPERATION

When the shaft 8 and the accelerator lever 6 of the fuel injection apparatus 2 are rotated producing an increase in load on the engine, the shaft 30 and the cam 28 coupled thereto are rotated causing the slidable body 27 to move up and decrease the load on the spring 26. Consequently, as shown in FIG. 2, the passage through the rod 24 which was previously closed by the double-headed valve 35 is opened providing communication between the actuating chamber 38 and the atmospheric chamber 23. This produces a pressure increase in the actuating chamber 38 and when the pressure differential across the diaphragm 22 is balanced with the load of the spring 26, the passage through the rod 24 is closed.

Conversely, when the engine load is reduced, by movement of the accelerator lever 6, the slidable body 27 moves downward and the inlet passage 9 previously closed by the double-head valve 35 is opened. Thus, the pressure in the actuating chamber 38 is reduced and when the vacuum pressure assumes a predetermined balanced value, the passage 9 is again closed by the double-head valve 35.

Figure 4:
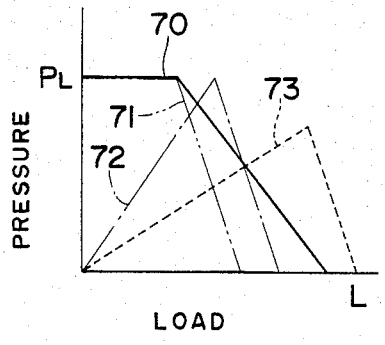
FIG. 4 is a diagrammatic view showing the operating characteristics of the load pressure converter shown in FIG. 2.

As indicated by a line 70 in FIG. 4, the vacuum pressure level $P_L$ at the passage 12 is determined by the operating angle of the accelerator lever 6 which in turn determines engine load L. As shown, the vacuum pressure at passage 12 gradually reduces over a predetermined operating angle of the accelerator lever 6. However, the configuration of the cam 28 can be varied to obtain other operating characteristics as shown by dashed lines 71, 72 and 73. In this manner, a vacuum pressure level generated in the actuating chamber 38 in response to variation in engine load is applied to the output chamber 65 of the speed pressure converter 14 via the passage 12.

Meanwhile, in the speed pressure converter 14, as the engine rpm increases, the fuel discharge pressure of the feed pump in the fuel injection apparatus also increases. That pressure is applied to the control chamber 62 via the passage 53. Consequently, the control diaphragm 52 is pressed down and the arm 42 is moved to a position in which the pressure differential across the diaphragm 52 is balanced with the load of the spring 56. Downward movement of the arm 42 moves the sleeve 60 down against the force of spring 68 while the valve body 27 is retained against the seat 66. This provides communication between the output chamber 65 and the atmospheric chamber 63 through the passages 57, 46 and 45 and clearance between the sleeve 60 and the valve body 47. Additional clearance can be provided by a slot 47*a* in the valve body 47. Thus, the vacuum pressure in the output chamber 65 decreases as shown by the line 75 in FIG. 5. Pressure in the output chamber 65 is fed by the output passage 48 to a vacuum pressure actuator for driving the EGR control valve 15.

Conversely, when the fuel discharge pressure in the control chamber 62 reduces in response to a reduction in engine rpm, the arm 42 moves upwardly. Accordingly, the sleeve 60 and the valve body 47 are raised by the spring 68 to open the valve seat 66 and establish communication between the output chamber 65 and the passage 12 from the pressure converter 13. Thus, output vacuum pressure fed from the output passage 48 to the vacuum pressure actuator increases.

Figure 5:
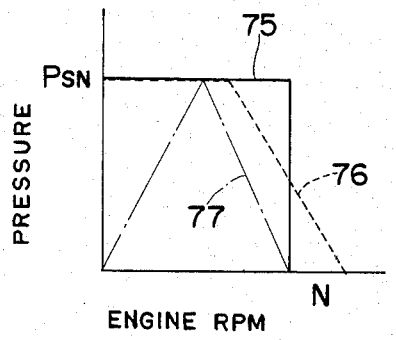
FIG. 5 is a diagrammatic view showing the operating characteristics of the speed pressure converter shown in FIG. 3.

In this manner, the vacuum pressure level from the load pressure converter 13 is controlled as shown by line 75 in FIG. 5 by the speed pressure converter 14. Output vacuum pressure $P_{SN}$ of the output chamber 65 with respect to changes in the engines rpm can be modified as shown by dashed lines 76 and 77 by suitably determining a throttle passage between the sleeve 60 and the valve body 47 and by the characteristics of the spring 68.

With the above-described arrangement, the present invention provides a reduction in unit price of manufacture because the construction thereof is simple as compared with conventional devices utilizing electrical output potentiometers for detecting position of the accelerator lever 6, electromagnetic coils for detecting engine rpm, and electromagnetic actuators for the EGR control valve 15. Furthermore, in the present invention, vacuum pressure obtained from the intake manifold of the engine is utilized as a power source and all the operations are performed mechanically, resulting in greater reliability.

Obviously, many modifications and variations of the present invention are possible in light of the above teachings. It is to be understood, therefore, that the invention can be practiced otherwise than as specifically described.

What is claimed is:

1. Diesel engine apparatus comprising:

a load responsive means providing a load mechanical output dependent on the load on the engine;

a source of vacuum pressure;

a load pressure converter communicating with said source and coupled to said load responsive means, said load pressure converter providing a load vacuum pressure level dependent on said load mechanical output;

a speed responsive means providing a speed mechanical output dependent on the revolution rate of the engine;

a speed pressure converter communicating with said load pressure converter and coupled to said speed responsive means, said speed pressure converter providing an output vacuum pressure level dependent on said load vacuum pressure level and said speed mechanical output; and an EGR control valve for regulating the flow of gases between the exhaust and the intake of the engine in response to said output vacuum pressure level.

2. Apparatus according to claim 1 wherein said load responsive means comprises an accelerator means for controlling the rate at which fuel is supplied to the engine.

3. Apparatus according to claim 1 wherein said speed responsive means is responsive to the fuel discharge pressure of the engine's fuel feed pump.

4. Apparatus according to claim 3 wherein said load responsive means comprises an accelerator means for controlling the rate at which fuel is supplied to the engine.

5. Apparatus according to claim 1 wherein said load pressure converter comprises a load housing, a flexible load diaphragm retained by said housing and disposed between an atmospheric chamber communicating with the atmosphere and an actuating chamber communicating with both said source and the atmosphere, said actuating chamber providing said load vacuum pressure level, and load valve means for controlling the degree of gas flow between said actuating chamber and both the atmosphere and said source in response to said load mechanical output.

6. Apparatus according to claim 5 wherein said load responsive means comprises an accelerator means for controlling the rate at which fuel is supplied to the engine.

7. Apparatus according to claim 5 wherein said load responsive means comprises bias means exerting a force on said load valve means, and cam means for altering said force in response to said load mechanical output.

8. Apparatus according to claim 7 wherein said speed pressure converter comprises a speed housing means defining an output chamber communicating with said load vacuum pressure and the atmosphere and providing said output vacuum pressure, a speed valve means for controlling the degree of gas flow between said output chamber and both the atmosphere and said load vacuum pressure, and wherein said speed valve means is controlled by said speed mechanical output.

9. Apparatus according to claim 8 wherein said speed responsive means comprises a control chamber partially defined by a flexible control diaphragm and receiving the fuel discharge pressure of the engine's fuel pump, and wherein movement of said flexible control diaphragm in response to changes in said fuel discharge pressure provides said speed mechanical output.

* * * * *